US005921026A

United States Patent [19]

Miller

[11] Patent Number: 5,921,026

[45] Date of Patent: Jul. 13, 1999

[54] ADJUSTABLE HEIGHT SENSING EDGE FOR A DOOR

[75] Inventor: Bearge D. Miller, West Grove, Pa.

[73] Assignee: Miller Edge, Inc., West Grove, Pa.

[21] Appl. No.: 08/776,796

[22] PCT Filed: Jun. 6, 1996

[86] PCT No.: PCT/US96/09207

§ 371 Date: Feb. 13, 1997

§ 102(e) Date: Feb. 13, 1997

[87] PCT Pub. No.: WO96/41062

PCT Pub. Date: Dec. 19, 1996

Related U.S. Application Data

[63] Continuation-in-part of application No. 08/476,429, Jun. 7, 1995, abandoned.

[51] Int. Cl.[6] ..... E05F 15/02

[52] U.S. Cl. ..... 49/27; 49/26

[58] Field of Search ..... 49/26, 27, 28; 200/61.43

[56] References Cited

U.S. PATENT DOCUMENTS

| | | | |
|---|---|---|---|
| 2,135,131 | 11/1938 | Bassett . | |
| 2,740,856 | 4/1956 | Doeg . | |
| 3,118,984 | 1/1964 | Koenig . | |
| 4,045,631 | 8/1977 | Dann . | |
| 4,051,336 | 9/1977 | Miller . | |
| 4,143,367 | 3/1979 | Schestag | 200/61.43 X |
| 4,349,710 | 9/1982 | Miller . | |
| 4,908,483 | 3/1990 | Miller . | |
| 4,972,054 | 11/1990 | Miller et al. . | |
| 5,023,418 | 6/1991 | Beckhausen . | |
| 5,027,552 | 7/1991 | Miller et al. . | |
| 5,072,080 | 12/1991 | Beckhausen . | |
| 5,148,911 | 9/1992 | Miller et al. . | |
| 5,259,143 | 11/1993 | Mitchell et al. . | |
| 5,327,680 | 7/1994 | Miller . | |
| 5,438,798 | 8/1995 | Plamper et al. | 49/28 |

FOREIGN PATENT DOCUMENTS

| | | |
|---|---|---|
| A-0-353332 | 7/1990 | European Pat. Off. . |
| A-0-405351 | 2/1991 | European Pat. Off. . |
| A-0-172136 | 12/1994 | European Pat. Off. . |

*Primary Examiner*—Jerry Redman
*Attorney, Agent, or Firm*—Panitch Schwarze Jacobs & Nadel, P.C.

[57] ABSTRACT

An adjustable height sensing edge for a door to protect persons, equipment and the door from impact damage from closing movement of the door by actuating a stopping device upon detecting an object in contact with the sensing edge, the device stopping the closing movement of the door. The adjustable-height sensing edge comprises a base member having opposing first and second surfaces. The first surface of the base member is adapted for attachment to the door. A first sensorless compressible spacer member having opposing first and second sides is provided. The first side of the sensorless spacer member is attached to the base member. A force sensor is provided for sensing the object in contact with the sensing edge and activating the stopping device. The force sensor has opposing first and second sides, with the first side of the force sensor being connected to the second surface of the base member.

15 Claims, 7 Drawing Sheets

ADJUSTABLE HEIGHT SENSING EDGE FOR A DOOR

This application is a 371 PCT/US96/09207 filed Jun. 06, 1996 which is a con-in-part of Ser. No. 08/476,429 filed Jun. 07, 1995 abandoned.

FIELD OF THE INVENTION

The present invention relates to a sensing edge for a door. More particularly, the present invention provides an adjustable height sensing edge for a door to protect persons, equipment and the door from impact damage caused by door movement.

BACKGROUND OF THE INVENTION

The use of force-sensing switches in sensing edges attached along the leading edges of doors is generally known in the art. Such sensing edges generally include a uniform height outer sheath in which a force-sensing switch is positioned. Upon the application of force to the sheath, the force-sensing switch actuates suitable control circuitry for controlling the movement of the door, generally stopping and/or reversing the closing movement of the door.

Generally, the force-sensing switch positioned within the sheath comprises a pair of flexible, electrically conductive sheets positioned on upper and lower sides of a layer of non-conducting foam having a plurality of openings extending therethrough from the upper to the lower side. Upon application of a force to the sheath, in a direction normal to the surface of the electrically conductive sheets, the sheets are deflected into electrically conductive engagement with each other to thereby actuate the control circuitry for controlling the door.

Another type of force-sensing switch which can be positioned within the sheath is a pressure switch. Pressure switches typically consist of an elongate tubular member, one end of which is sealingly closed. The other end of the tubular member is in fluid communication with a pressure-sensitive switch. The tubular member is longitudinally positioned within the sheath such that upon the application of a force to the sheath, pressure within the tubular member is increased, activating the pressure-sensitive switch which signals suitable control circuitry for controlling the movement of the door.

While conventional sensing edges of this type are generally suitable for many applications, damage may still result to persons, equipment or the door edge after the sensing edge has signaled the control device for the door to stop or reverse the movement of the door based on the stopping distance of the door. For applications such as aircraft hangar doors, where the mass of the door is substantial, the stopping distance may be several inches during which time the object which actuated the sensor is acted upon by the leading edge of the door as the door comes to a complete stop and/or reverses direction.

One known prior art device provides an extruded, one-piece seal having flexible hollow chambers adjacent to the sensing edge to provide for some deflection of the sensing edge to prevent damage to an object in the path of the closing door after the sensing edge detects the presence of the object.

However, the known prior art devices have a specific, predetermined compressible height to prevent damage to the object and the door edge as the door is stopped. In order to compensate for varying door stopping distances based on varying door-closing speeds and door mass, seals having different heights, cross-sections and/or material properties had to be used for different applications.

Additionally, the presently known prior art devices are worn out through use by the constant abrasion of the sheath which houses the force sensing elements. In some applications the ends of the force sensors are also worn through by abrasion against the door jams, and, in applications having doors which are opened and closed at speeds of 4–5 feet per second, the force sensing edges and the door edges are sometimes damaged by collisions with vehicles traveling through the doors which contact the sensing edge and door edge, without necessarily triggering the force sensing switch.

The present invention is a result of observation of the need for an adjustable-height sensing edge to compensate for different door configurations and door closing speeds such that the same sensing edge can be used on various doors to protect persons, equipment and the door from impact damage. By providing an adjustable height-sensing edge, the present invention overcomes the problems inherent in the prior art by allowing the height of a sensing edge to be adjusted to meet the requirements of different door applications.

SUMMARY OF THE INVENTION

Briefly stated, the present invention comprises an adjustable height sensing edge for a door to protect persons, equipment and the door from impact damage from closing movement of the door by actuating a stopping device upon detecting an object in contact with the sensing edge, the stopping device stopping the closing movement of the door. The adjustable-height sensing edge comprises a first compressible spacer member having opposing first and second sides. The first side of the spacer member is adapted for attachment to the door. A force sensor is provided for sensing the object in contact with the sensing edge and activating the stopping device. The force sensor has opposing first and second sides, with the first side of the force sensor being connected to the second surface of the base member.

In a further aspect, the present invention comprises a spacer member for a sensing edge for a door, with the sensing edge being attached to the door edge to protect persons, equipment and the door from impact damage caused by closing movement of the door by actuating a stopping device upon detecting an object in contact with the sensing edge to halt the closing movement of the door. The spacer member comprises a generally flexible, elongate tube having first and second opposing sides. The tube is compressible in a direction normal to the opposing first and second sides. A connector attachment of a first type, including a first male connector member, is located on the first side of the tube. The first male connector member includes a stem portion and a retainer portion. The stem portion has a first end and a second end, the first end is connected to the first side of the tube, with the stem extending in a direction generally normal to the first side. The retainer portion is affixed to the second end of the stem portion, with the retainer portion having a width which is greater than a width of the stem portion. A connector attachment of a second type is also provided. The connector attachment of the second type includes a first female connector channel located on the second side of the tube in a generally aligned position with the first male connector member on the first side of the tube. The first female connector channel includes a first wall extending from the second side of the tube and a second wall extending from the second side of the tube located generally parallel to and spaced from the first wall to form a cavity therebetween. The cavity has an opening which is narrower than the width of the retainer portion of the male connector portion on the first side.

In a further aspect, the present invention comprises a protective outer sheath for a sensing edge which is attached to a door edge to protect persons, equipment and the door from impact damage from closing movement of the door by actuating a device upon detecting an object in contact with the sensing edge to halt the closing movement of the door. The protective outer sheath provides protection for the sensing edge from abrasion damage and includes a flexible, elongate wall having a first end and a second end. The first and second ends are attached to the door such that the sensing edge is covered by the wall.

In a further aspect, the present invention comprises a method of assembling an adjustable height sensing edge to a door for protecting persons, equipment and the door from impact damage caused by closing movement of the door into one of persons and equipment by actuating a stopping device upon detecting an object in contact with a force sensor located on an edge of the door to stop the closing movement of the door, the door having a predetermined stopping distance. The method comprises the steps of: attaching a base member for a sensing edge to a door; determining a number of compressible spacer members to attach to the base member based on a compressible height of each spacer member and the predetermined stopping distance of the door; attaching the determined number of spacer members to the base member; and attaching a force sensor to a last spacer member of the determined number of spacer members.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 5 of a third preferred embodiment of an adjustable-height sensing edge in accordance with the present invention.

DETAILED DESCRIPTION OF PREFERRED EMBODIMENTS

Figure 1:
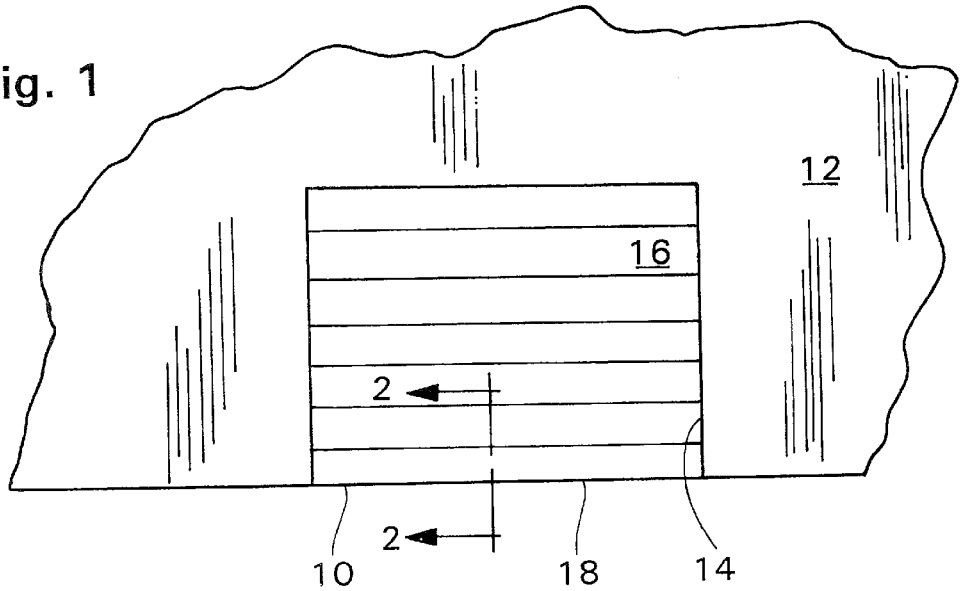
FIG. 1 is an elevational view showing a door construction including a height-adjustable sensing edge in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the adjustable height sensing edge and designated parts thereof. The terminology includes the words above specifically mentioned, derivatives thereof and words of similar import.

Referring to the drawings, wherein like numerals indicate like elements throughout and identical elements in the same figures have been identified as typical (i.e. "(TYP)"), there is shown in FIGS. 1–4 a first preferred embodiment of an adjustable-height sensing edge, generally designated 10, in accordance with the present invention. The adjustable height sensing edge 10 is intended for use with automatically closing doors to protect persons, equipment and the door from impact damage from closing movement of the door by actuating a stopping device associated with the door closing mechanism upon detecting an object in contact with the sensing edge. Stopping devices for automatically closing doors are generally known to those of ordinary skill, and may comprise a relay or switch which interrupts current to the door-closing mechanism, or reverses movement of the door-closing mechanism. It is also understood by the ordinarily skilled artisan that the type of door-closing mechanism and stopping device are not pertinent to the present invention, and can be varied, and accordingly, further description is not believed necessary or limiting.

Referring to FIG. 1, there is shown a building wall 12 having a doorway 14 with a door 16'. While the door 16, as illustrated, is an overhead door having a height-adjustable sensing edge 10 in accordance with the present invention along its lower side or leading edge 18, it is within the spirit and scope of the invention to incorporate the height-adjustable sensing edge 10, described hereinafter, along the edge of any door structure, such as vertically disposed or horizontally movable doors (not shown) as desired. Moreover, it is understood by those skilled in the art that the height-adjustable sensing edge 10 is not limited to use in conjunction with doors, but can be used for other applications, such as automatic windows.

Figure 2:
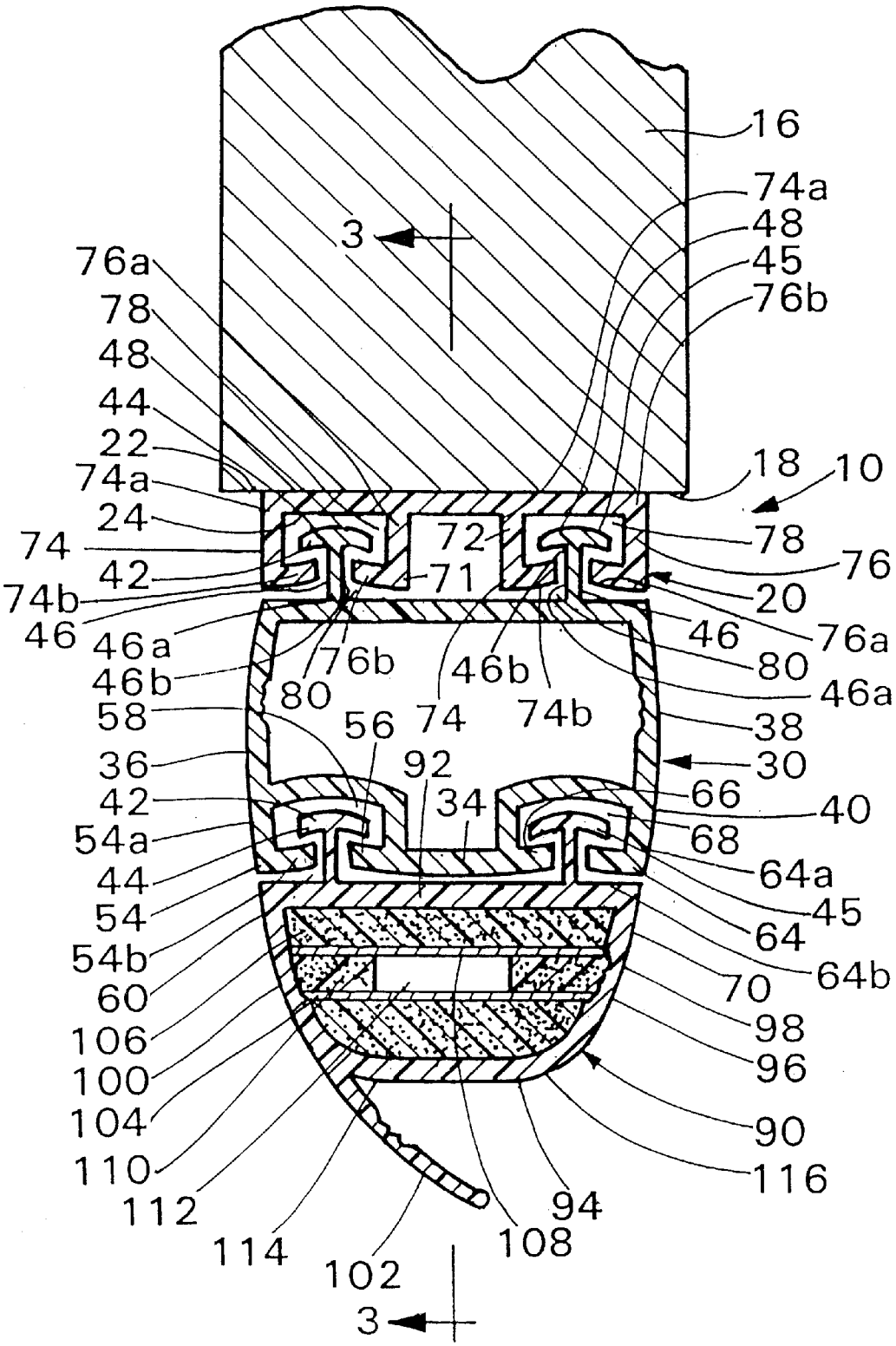
FIG. 2 is a greatly enlarged cross-sectional view of the sensing edge of FIG. 1 in accordance with a first preferred embodiment of the present invention taken along lines 2—2 in FIG. 1.

Referring now to FIG. 2, the first preferred embodiment of the adjustable-height sensing edge 10 is shown in detail attached to the leading edge 18 of the door 16. The adjustable-height sensing edge 10 includes a base member 20 having opposing first and second surfaces 22 and 24. The first surface 22 of the base member is adapted for attachment to the door 16. In the first preferred embodiment, the first surface 22 of the base member 20 is attached to the leading edge 18 of the door 16 by an adhesive material located on the first surface 22 of the base member 20. However, it is understood by those of ordinary skill in the art from the present disclosure that the base member 20 may be affixed to the leading edge 18 of the door 16 by other means, such as mechanical fasteners including screws or nails, or may be configured to interlock with a slot or channel (not shown) in the leading edge 18 of the door 16.

Still with reference to FIG. 2, the adjustable-height sensing edge 10 further comprises a first compressible spacer member 30 having opposing first and second sides 32 and 34. Preferably, third and fourth sides 36 and 38 are connected between the respective edges of the first and second sides 32 and 34, forming a generally flexible, elongate tube 40. The tube 40 is compressible in a direction normal to the opposing first and second sides 32 and 34.

The first side 32 of the spacer member 30 is attached to the leading edge 18 of the door 16 via the base member 20. The first side 32 of the spacer member 30 includes a connector attachment of a first type 42 which engages a connector attachment of a second type 50, described in detail below, on the second surface 24 of the base member 20 extending the width of the door 16. Preferably, the connector attachment of the first type 42 comprises a first male connector member 44 located on the first side 32 of the tube 40. The first male connector member includes a stem portion 46 and a retainer portion 48. The stem portion 46 has a first end 46*a* and a second end 46*b*. The first end 46*a* is connected to the first side 32 of the tube 40 and the stem 46 extends in a direction generally normal to the first side 32. The retainer portion 48 is affixed to the second end 46*b* of the stem portion 46. The retainer portion 48 has a width which is greater than a width of the stem portion 46.

As shown in FIG. 2, preferably the connector attachment of the first type 42 includes first and second male connector members 44 and 45 located on the first side 32 of the spacer member 30. The second male connector member 45 is located on the first side 32 of the tube 40 in a position generally parallel to and spaced from the first male connector member 44. The second male connector member 45 includes a stem portion 46 and a retainer portion 48, as described above.

Still with reference to FIG. 2, the second side 34 of the spacer member 30 includes a connector attachment of a second type 50. Preferably, the connector attachment of the second type 50 comprises a first female connector channel 52 located on the second side 34 of the tube 40 of the first spacer member 30. The first female connector channel 52 is in a generally aligned position with the male connector member 44 on the first side 32 of the tube 40. The first female connector channel 52 includes a first wall 54 extending from the second side 34 of the first spacer member 30, and a second wall 56 extending from the second side 34 of the spacer member 30, located generally parallel to and spaced from the first wall 54 to form a cavity 58 therebetween. The first and second walls 54 and 56 have first and second ends 54*a*, 56*a* and 54*b*, 56*b*, respectively, and the first ends 54*a* and 56*a* of the first and second walls 54 and 56 are connected to the second side 34 of the spacer member 30. The cavity 58 has an opening 60, formed between the second ends 54*b* and 56*b* of the first and second walls 54 and 56, which is narrower than the width of the retainer portion 48 of the male connector member 44 on the first side 32 of the spacer member 30.

Preferably, the connector attachment of the second type 50 includes a second female connector channel 62 located on the second side 34 of the tube 40 of the spacer member 30 in a generally aligned position with the second male connector member 45 on the first side 32 of the tube 40, in a position generally parallel to and spaced from the first female connector channel 52 on the second side 34 of the tube 40. The second female connector channel 62 is similar to the first female connector channel 52 and includes a third wall 64 extending from the second side 34 of the tube and a fourth wall 66 extending from the second side 34 of the tube 40, the fourth wall 66 being located generally parallel to and spaced from the third wall 64 to form a second cavity 68 therebetween. The third and fourth walls 64 and 66 have first and second ends 64*a*, 66*a* and 64*b*, 66*b*, respectively, and the first ends 64*a* and 66*a* of the third and fourth walls 64 and 66 are connected to the second side 34 of the spacer member 30. The cavity 68 has an opening 70, formed between the second ends 64*b* and 66*b* of the third and fourth walls 64 and 66, which is narrower than the width of the retainer portion 48 of the second male connector member 45 on the first side 32 of the spacer member 30.

The first compressible spacer member 30 is preferably molded from a resilient, polymeric material having a Shore A durometer of about 60–85. In a preferred embodiment, the first compressible spacer member 30 is extruded from Santoprene™ 101-55 which is available from Monsanto Co. of St. Louis, Mo. Preferably, the first compressible spacer member 30 is a hollow, substantially rectilinear structure. However, it is understood by those of ordinary skill in the art from the present disclosure that the shape of the first compressible spacer member 30 can be varied. For example, the cross-section could be oval or circular. Additionally, it is similarly understood that other materials and methods of manufacture can be utilized to construct the spacer member 30 within the scope of the present invention. For example, the first compressible spacer member could be formed from an open or closed cell foam material which is cut to shape from bulk material, and may be formed as a tube or as a solid compressible member. The spacer member may also be made from other suitable polymeric materials such as polyvinylchloride or neoprene. Additionally, it is similarly understood that the type of connection between the first spacer member 30 and the base member 20 can be made by various means, such as adhesive attachment, the use of other suitable connector attachments, such as interlocking channel members, or other suitable means. It is similarly understood that the female connector channels 52 could be located on the first side 32 of the first compressible spacer member 30 and male connector members 44 could be located on the second side 34 of the first compressible spacer member 30, and that the location and type of connector attachment utilized is not considered limiting.

As shown in FIG. 2, the base member 20 also includes a connector attachment of the second type 50 on the second surface 24 of the base member 20. The spacer member 30 is preferably connected to the base member 20 by engagement of the connector attachment of the first type 42 on the first side 32 of the spacer member 30 engaging the connector attachment of the second type 50 on the second surface 24 of the base member 20. Preferably, the connector attachment of the second type 50 on the second surface 24 of the base member 20 includes third and fourth female connector channels 72, having a similar configuration to the first and second female connector channels 52 and 62 on the second side 34 of the first spacer member 30. The third and fourth female connector channels 71, 72 on the second surface 24 of the base member 20 include first and second walls 74 and 76. A cavity 78 is defined between each set of first and second walls 74, 76. Each wall 74, 76 has a first end 74*a*, 76*a* and a second end 74*b*, 76*b*. The first ends 74*a*, 76*a* are affixed to the second surface 24 of the base member 20, and the second ends 74*b*, 76*b* extend toward each other to define an opening 80 therebetween which is narrower than the width of the retainer portions 48 of the first and second male connector members 44, 45. As shown in FIG. 2, preferably the female connector channels 71, 72 are in an aligned position with the male connector members 44, 45 on the first side 32 of the spacer member 30.

The base member 20 is preferably molded from a polymeric material. In the preferred embodiment, the base member 20 is extruded from Santoprene™ 103-50 which is available from Monsanto Co. However, it is understood by those of ordinary skill in the art from the present disclosure that the base member 20 could be made by other methods, such as machining or bending from a variety of materials, such as aluminum or other metals or other suitable polymeric materials such as polyvinylchloride, neoprene or other suitable materials, if desired. It is similarly understood that the connection between the base member 20 and the first compressible spacer member 30 can be made by an adhesive connection or other types of connector attachments, and is not necessarily limited to the male connector members 44, 45 and female connector channels 71, 72 shown. Additionally, it is similarly understood by those of ordinary skill in the art that male connectors could be attached to the base member 20 and the female connector channels attached to the first compressible spacer, if desired. Accordingly, the type of attachment employed between the first compressible spacer member 30 and the base member 20 may be made by various other suitable means, such as adhesive attachment or the use of other suitable connector attachments, such as interlocking channel members, or a combination of adhesive attachment and attachment by mating connectors (especially in industrial environments), or other suitable means, and the type of attachment utilized is not considered limiting. It is also understood by those of ordinary skill in the art that base member 20 could be omitted and the spacer 30 could be directly attached to the leading edge 18 of the door 16 in any suitable manner, such as by an adhesive.

The adjustable-height sensing edge 10 further comprises a force sensor 90 for sensing the object in contact with the sensing edge 10 and activating the stopping device (not shown). The force sensor 90 has opposing first and second sides 92 and 94. The first side 92 of the force sensor 90 is connected to the second surface 24 of the base member 20, preferably through connection to one or more compressible spacer members 30.

As shown in FIG. 2, the force sensor 90 includes third and fourth sides 98 and 100 connected between the side edges of the first and second sides 92 and 94 to form a sheath 96. Preferably, a lip seal 102 depends from the second side 94 for enhanced sealing.

The first side 92 of the force sensor 90 includes a connector attachment of the first type 42. The force sensor 90 is attached to the spacer member 30 by the connector attachment of the first type 42 on the first side 92 of the force sensor 90 engaging the connector attachment of the second type 50 on the second side 34 of the spacer member 30.

As shown in FIG. 2, the first side 92 of the force sensor 90 includes first and second male connector members 44 and 45 as described above in connection with the first compressible spacer member 30, with the first and second male connector members 44 and 45 on the force sensor 90 being in a generally aligned position with the first and second female connector channels 52 and 62 on the second side 34 of the first compressible spacer member 30.

In the preferred embodiment, the sheath 96 of the force sensor 90 is made from a flexible, resilient material such as Santoprene™ 103-50 from Monsanto Co having a Shore A durometer of approximately 60. Preferably, the sheath 96 is extruded, and the first and second male connector members 44 and 45 are integrally formed with the sheath 96. However, it is understood by those of ordinary skill in the art from the present disclosure that the sheath 96 for the force sensor 90 can be made from other resilient materials, such as suitable polymeric materials, and may be made by other methods, such as forming the sheath 96 by connecting the ends of a flat sheet of polymeric material and attaching the first and second male connector members 44 and 45 in a secondary operation.

Figure 3:
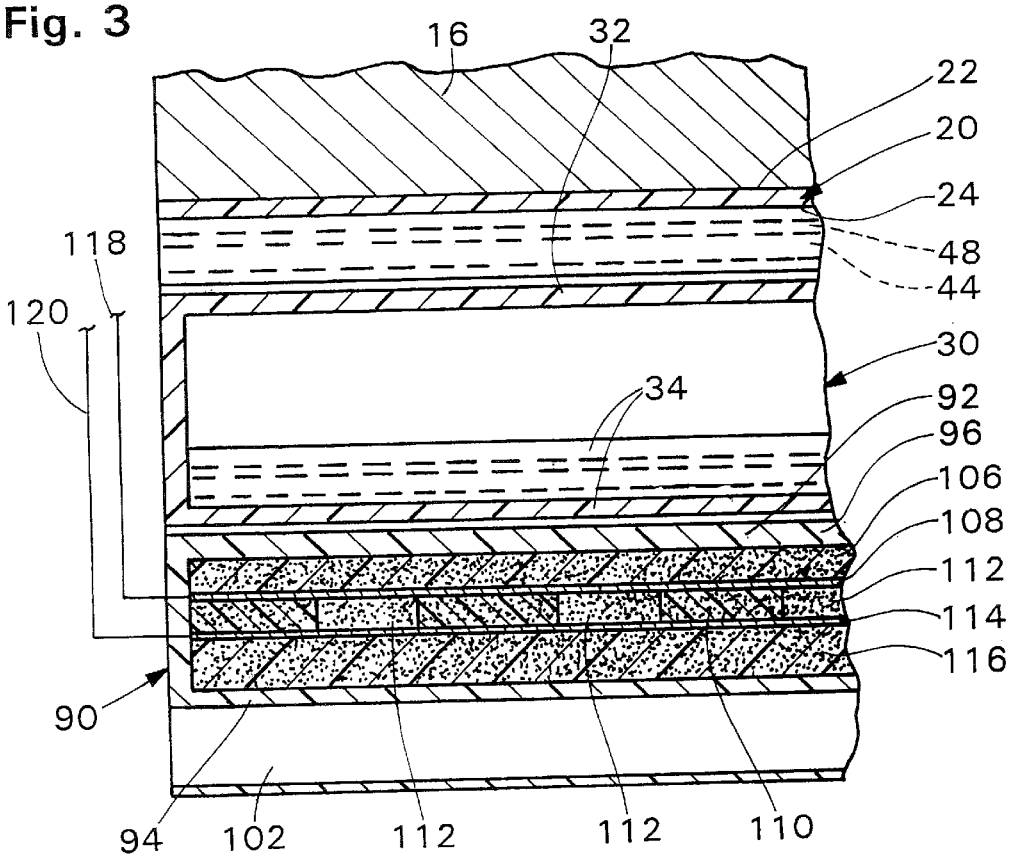
FIG. 3 is a cross-sectional view of a portion of the adjustable-height sensing edge shown in FIG. 2 taken along lines 3—3 of FIG. 2.

As shown in FIGS. 2 and 3, the force sensor 90 comprises a multi-layered force-sensing electrical switch 104, as described below. A first sheet of resiliently compressible material 106 is positioned within the sheath 96 adjacent to the first side 92. Just below the first sheet of resiliently compressible material 106 is a first flexible sheet of electrically conductive material 108. Below the first sheet of electrically conductive material 108 is a compressible layer of non-conductive material 110 having at least one opening 112 extending therethrough. As shown in FIG. 3, the layer of non-conductive material 110 preferably includes a plurality of openings 112 interspersed therealong to allow actuation of the force sensing switch 104 by applying pressure thereto, as described hereinafter. Preferably, the openings 112 are generally oval-shaped in cross section. However, the openings 112 may be configured with any geometric shape, such as a square or circle. A second sheet of flexible electrically conductive material 114 is positioned beneath the layer of non-conductive material 110. A second sheet of resiliently compressible material 116 is located beneath the second sheet of electrically conductive material 114.

In the preferred embodiment, the first and second sheets of compressible material 106 and 116 are preferably made of a generally soft foam rubber. However, it is understood by those of ordinary skill in the art from the present disclosure that the first and second resiliently compressible sheets 106 and 116 can be constructed of other materials, such as open or closed cell foam rubber, or other suitable compressible materials having similar properties. Preferably, the first and second sheets of electrically conductive material 108 and 114 are constructed from thin aluminum or aluminum foil. However, it is within the spirit and scope of the invention to construct the first and/or second sheet of any other suitable flexible, electrically conductive material, such as copper, brass or an electrically conductive flexible plastic. Preferably, the layer of non-conductive material 110 between the first and second sheets of flexible electrically conductive material 108 and 114 is constructed of a soft foam rubber. It is similarly understood by those of ordinary skill in the art from the present disclosure that the layer of non-conductive material 110 can be constructed of either open or closed cell foam rubber or other materials having the desired properties, so long as the function of the force sensing switch 104 is achieved. Switches of these types are generally known in the art, as described in applicant's U.S. Pat. No. 5,027,552, which is incorporated herein by reference as if fully set forth herein.

As shown in FIG. 3, preferably electrical conductors or wires 118 and 120 are connected to the first and second flexible electrically conductive sheets 108 and 114, respectively. The conductors 118, 120 may extend out from the end of the force sensor 90, as shown, or may be pulled up through apertures (not shown) punched through the spacer member(s) 30 to protect the conductors 118, 120 from damage during use. The electrical conductors 118 and 120 are used in connection with a circuit (not shown) for controlling the actuation of the stopping device on the door 16 in response to the application of force to the sheath 96. Alternatively, a battery powered radio transmitter (not shown) could be housed in the spacer 30 and communicate with the circuit (not shown) for controlling the actuation of the stopping device to render the sensing edge 10 wireless. Such a transmitter could maintain the door 16 in the closed position upon the battery becoming drained.

While it is preferred that the force sensor 90 be positioned in the lowermost section of the sensing edge 10, it is understood by those of ordinary skill in the art that the force sensor 90 could be located between the spacer 30 and the door 16 by adjusting the relative flexibility of the force sensor 90 and the spacer 30.

Figure 4:
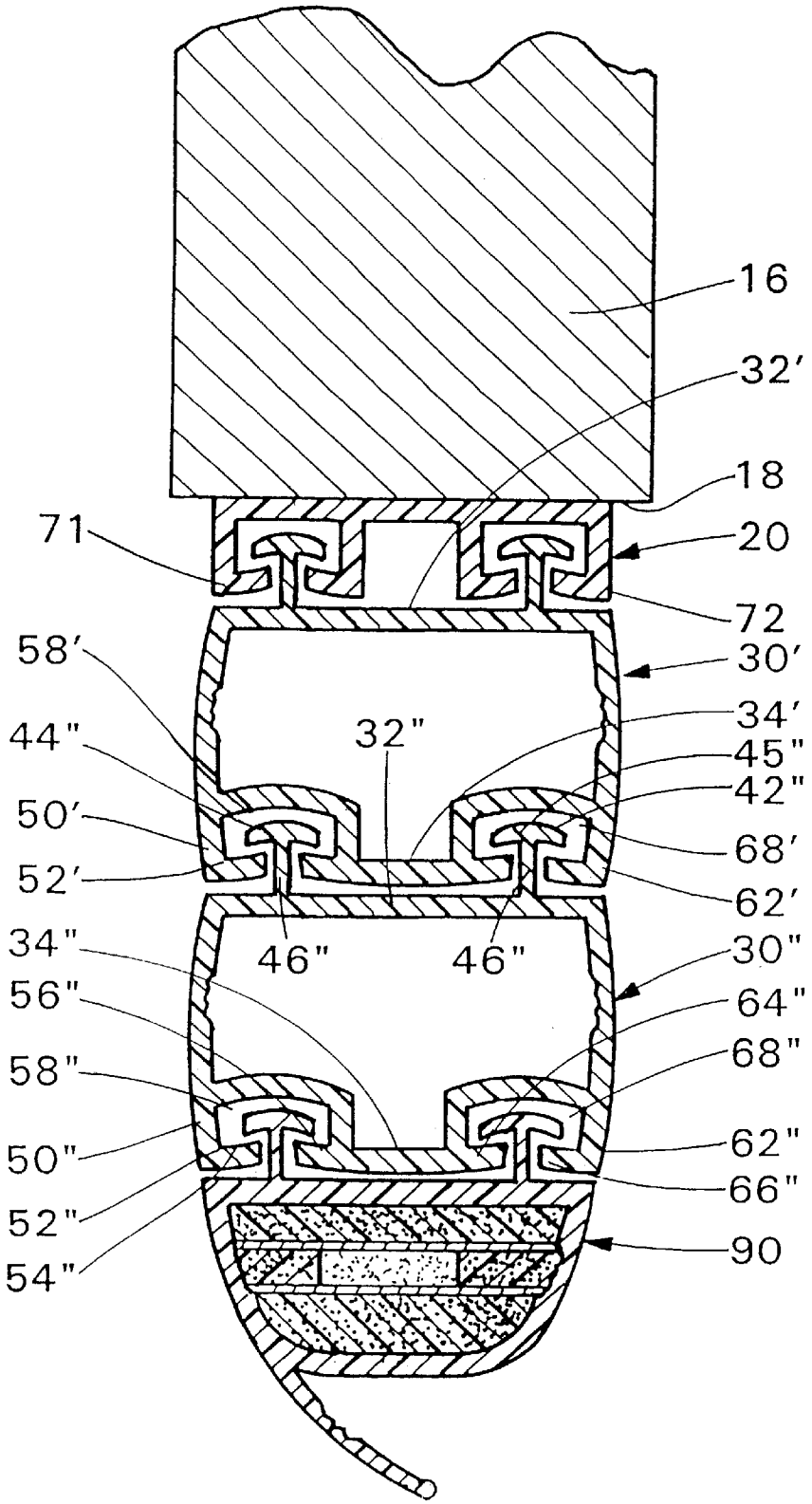
FIG. 4 is a greatly enlarged cross-sectional view similar to FIG. 2 showing the use of two spacer members.

Referring now to FIG. 4, the adjustable-height sensing edge 10 is shown with first and second spacer members 30' and 30". The first and second spacer members 30' and 30" are identical to the spacer member 30 described above, and elements have been designated prime for the first spacer member 30' and double prime for the second spacer member 30" for convenience only in referring to the drawing figure. The second compressible spacer member 30" is disposed between the first compressible spacer member 30' and the force sensor 90. The second spacer member 30" has opposing first and second sides 32" and 34". The first side 32" of the second spacer member 30" includes a connector attachment of the first type 42 and the second side 34" of the second spacer member 30" includes a connector attachment of the second type 50. The first side 32" of the second spacer member 30" is connected to the second side 34' of the first spacer member 30' by the connector attachment of the first type 42 on the first side 32" of the second spacer member 30" engaging the connector attachment of the second type 50 on the second side 34' of the first spacer member 34. The force sensor 90 is connected to the second side 34" of the second spacer member 30" by the connector attachment of the first type 42 on the first side 92 of the force sensor 90 engaging the connector attachment of the second type 50 on the second side 34" of the second spacer member 30". Preferably, the first and second spacer elements 30' and 30" are interchangeable.

Figure 7:
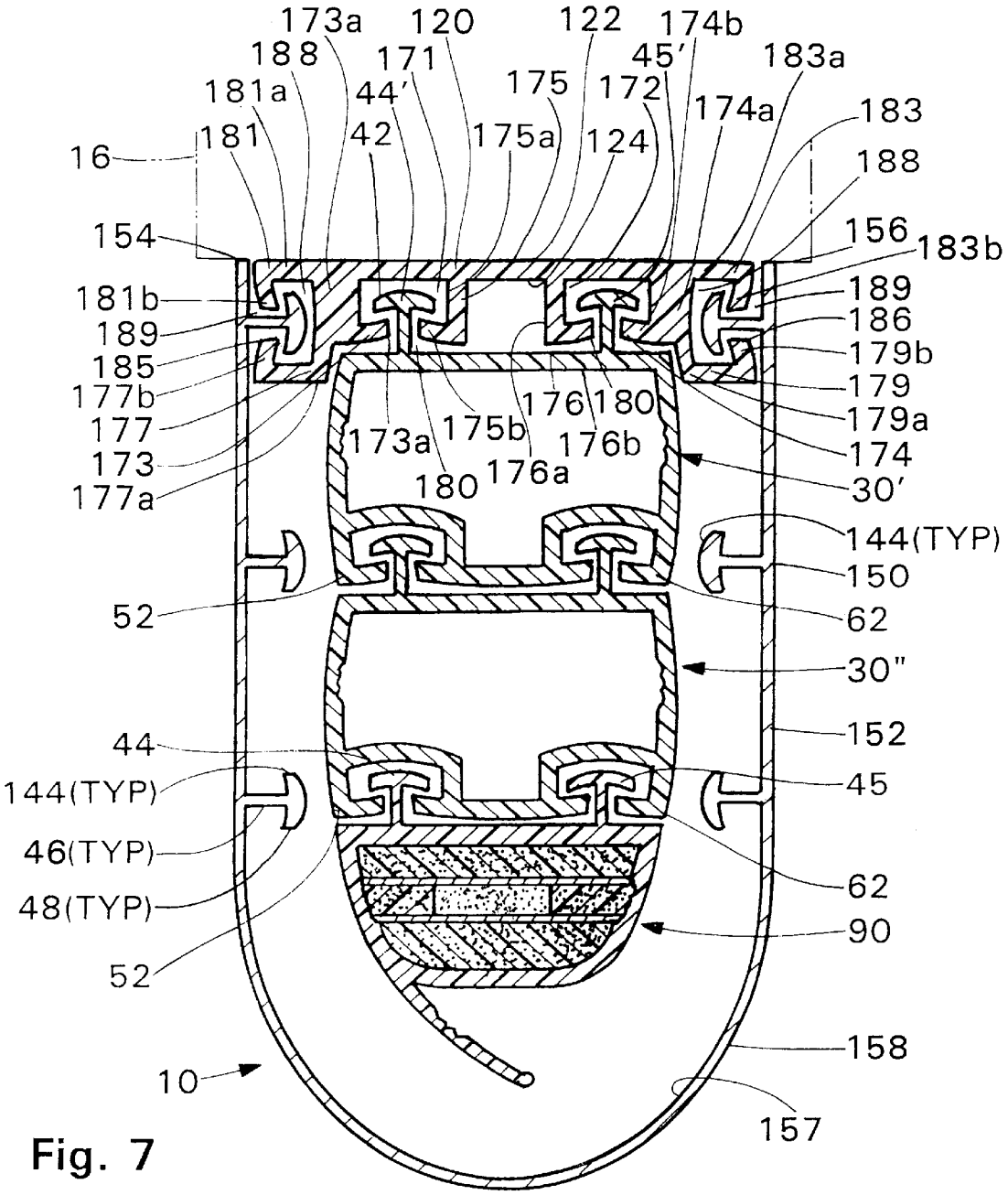
FIG. 7 is a cross-sectional view similar to FIG. 4 of a first height adjustable outer sheath for the adjustable-height sensing edge in accordance with the first preferred embodiment of the present invention.

Referring now to FIG. 7, the adjustable height sensing edge 10 is shown with a first protective outer sheath 150 which covers the first compressible spacer member 30' and the force sensor 90, and preferably covers the compressible spacer members 30', 30", etc, and the force sensor 90. The first protective outer sheath 150 includes a flexible, elongate wall 152 having first and second ends 154 and 156, and first and second surfaces 157 and 158. The first and second ends 152, 154 are attached to one of the door 16 and a second base member 120.

Preferably, the first protective outer sheath 150 includes at least one connector member 144 located on a first surface 157 of the first protective outer sheath 150, which extends the length of the outer sheath 150. In the preferred embodiment, a plurality of connector members 144 extend the length of the first protective outer sheath 150 along the first surface 157 to provide adjustment for installing the protective outer sheath 150 over the assembly of spacer members 30 and the force sensor 90 based on the number of spacer members 30 required for a particular application. The connector members 144 are male connector members similar to the first male connector member 44, described above. Each connector member 144 includes a stem portion 46, which is attached to the first surface 157 of the protective outer sheath, and a retainer portion 48 as described above.

In the preferred embodiment, the first protective outer sheath 150 is made of a polymeric material. Preferably, the material has a Shore A durometer of approximately 60, and may be made of rubber, neoprene, or other suitable abrasion resistant material. Preferably, the second surface 158 of the protective outer sheath 150, which is visible after installation, is marked with black and yellow warning stripes.

As shown in FIG. 7, the second base member 120 is similar to the first base member 20, and includes first and second surfaces 122 and 124. The first surface 122 is configured for attachment to the leading edge 18 of the door 16. The second base member 120 also includes a connector attachment of the second type 50 on the second surface 124 of the second base member 120. Preferably, the connector attachment of the second type 50 on the second surface 124 of the base member 120 includes fifth and sixth female connector channels 171, 172, having a similar configuration to the third and fourth female connector channels 71, 72 on the second surface 24 of the second base member 20. The fifth and sixth female connector channels 171 and 172 on the second surface 124 of the base member 20 include first walls 173, 174 and second walls 175, 176, respectively. Cavities 178 are defined between each set of first and second walls 173, 175 and 174, 176. Each wall 173–176 has a first end **173*a*–176*a* and a second end 174*b*–176*b*, respectively. The first ends 173*a*–176*a* are affixed to the second surface 124 of the second base member 120, and the second ends 173*b*, 175*b* and 174*b*,176*b*, respectively, extend toward each other to define openings 180 therebetween which are narrower than the width of the retainer portions 48 of the male connector members 44, 45 on the compressible spacer member 30. As shown in FIG. 7, preferably the female connector channels 171, 172 are in an aligned position with the male connector members 44', 45' on the first side 32' of the first spacer member 30'**.

The second base member 120 also includes connector attachments of the second type 50 along the longitudinal edges of the base member 120. The connector attachments of the second type along the longitudinal edges of the base member 120 are preferably seventh and eighth female connector channels 185, 186, which are similar to the fifth and sixth female connector channels 171, 172, but are preferably oriented in a direction approximately normal to the fifth and sixth female connector channels 171, 172. The seventh and eighth female connector channels 185 and 186 include first walls 177, 179 and second walls 181, 183, respectively. Cavities 188 are defined between each set of first and second walls 177, 181 and 179, 183. Each wall 177, 179, 181, 183 has a first end **177*a*–183*a* and a second end 177*b*–183*b*. The first ends 177*a*–183*a* are affixed to the lateral edges of the base member 120, and the second ends 177*b*, 181*b* and 179*b*, 183*b*, respectively extend toward each other to define openings 189 therebetween which are narrower than the width of the retainer portions 48 of the male connector members 144 on the first surface 157 of the protective outer sheath 150**.

Preferably, one male connector member 144 adjacent to each end 154, 156 of the protective outer sheath 150 is engaged in each of the seventh and eighth female connector channels 185, 186 to hold the protective outer sheath 150 in position around the base member 120, the spacer members 30', 30" and the force sensor 90 to provide additional protection to the height adjustable sensing edge 10 from damage. However, it is understood by those of ordinary skill in the art from the present disclosure that other means, such as adhesives or mechanical fasteners can be used to maintain the protective outer sheath 150 in position on the leading edge 18 of the door 16, if desired, and the male connector members 144 are optional.

Figure 5:
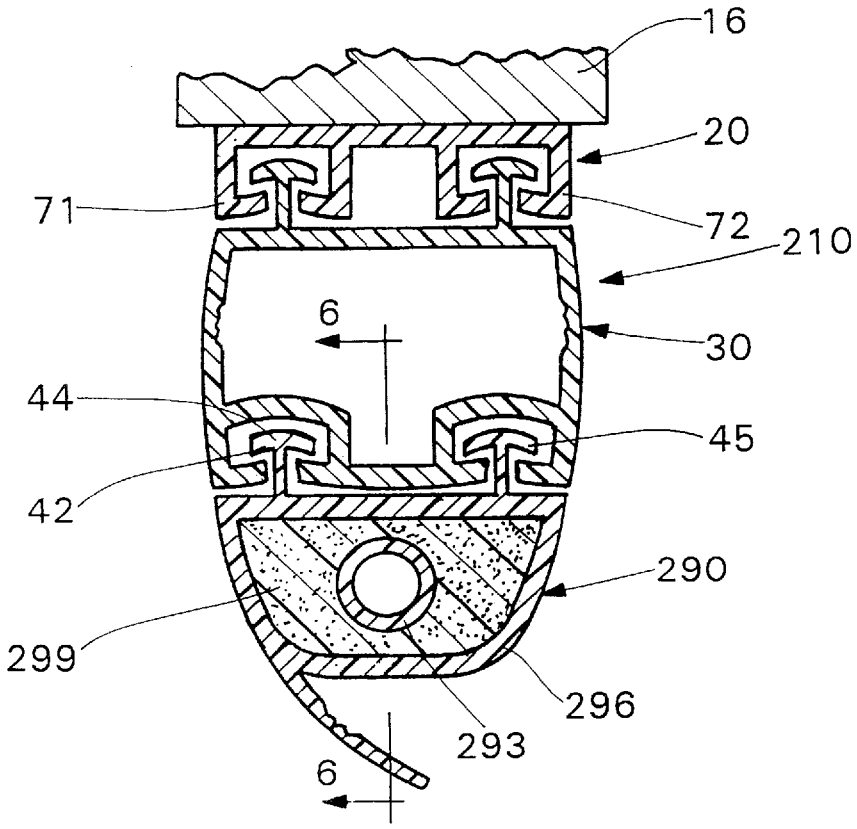
FIG. 5 is a cross-sectional view similar to FIG. 2 of a second preferred embodiment of an adjustable-height sensing edge in accordance with the present invention.
Figure 6:
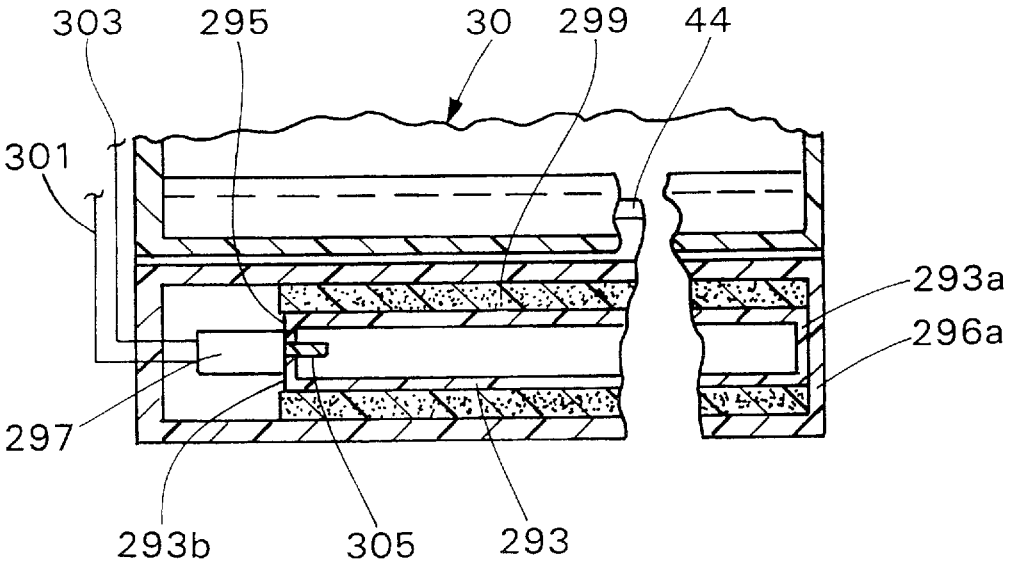
FIG. 6 is a cross-sectional view of the second embodiment of the adjustable-height sensing edge shown in FIG. 5 taken along lines 6—6 of FIG. 5.

Referring now to FIGS. 5 and 6, a second preferred embodiment of an adjustable height sensing edge 210 for a door 16 is shown. The second embodiment 210 is identical to the first embodiment, except the force sensor 90 has been replaced with a pneumatic force sensor 290. The force sensor 290 is similar to the force sensor 90 in the first embodiment and includes a connector attachment of the first type 42 on a first side 292 of the outer sheath 296. Preferably, the connector attachment of the first type 42 comprises first and second male connector members 44, 45 as previously described in connection with the first embodiment 10.

The force sensor 290 further comprises an elongate tubular member 293 fabricated of resiliently compressible air impervious material, such as rubber or closed cell foam, located inside the sheath 296. The tubular member 293 extends almost the complete length of the sheath 296 and is longitudinally positioned and completely enclosed within the sheath 296. The tubular member 293 has a generally circular cross-section, but may be of other cross-sectional shapes, such as square or oval (not shown). The tubular member 293 has first and second ends 293*a*, 293*b*, respectively. The first end 293*a* is in abutting engagement with a first closed end 296*a* of the sheath 296. The second end 293*b* of the tubular member 293 is sealed with a plug 295. The plug 295 includes a generally centrally disposed bore (not shown) for receiving a pressure sensing switch element 297 within the tubular member 293.

Disposed in the area between the sheath 296 and the tubular member 293 is a resiliently compressible inner formation 299 which extends generally along the entire length of the tubular member 293. In the presently preferred embodiment, the resiliently compressible inner formation 299 is preferably fabricated essentially of open cell foam and is substantially co-extensive with the sheath. Those of ordinary skill in the art will recognize that the resiliently compressible inner formation 299 may be made of other materials, such as closed cell foam. Additionally, it is similarly understood that the resiliently compressible inner formation 299 is not necessary for the operation of the sensing edge 290 and, therefore, may not be included. Thus, the area between the inner tubular member 293 and the sheath 296 may be open. However, without the resiliently compressible inner formation 299, the sensitivity of the sensing edge 290 decreases. It is similarly understood by those of ordinary skill in the art that the ends of the tubular member 293 may be sealed by various means such as plugs made of open or closed cell foam material which is impervious to air, or may be constructed of plastic. Additionally, the tubular member 293 may be formed with the first end 293*a* permanently sealed.

The pressure sensor 297 is preferably connected by conductors 301, 303 to the stopping device for stopping the closing movement of the door 16. Preferably, the pressure sensitive switch element 297 is a type well known in the art. Such pressure sensor switch elements are manufactured by Micropneumatic Logic, Inc., of Fort Lauderdale, Fla. Such switch elements 297 generally include a pressure port or nipple 305, which extends through the plug 295 and communicates with the interior of the tubular member 293. The switch element 297 is, therefore, in pneumatic communication with the interior of the tubular member 293. Upon the application of an external force to the sheath 296 caused by an obstruction contacting the leading edge 18 of the door 16 anywhere therealong, the compressible inner formation 299 (or the air within the outer sheath 296 if no compressible inner formation 299 is used) communicates the force to the tubular member 293 which is depressed in an amount proportional to the magnitude of the external force. A depression in the tubular member 293 increases the internal pressure within the tubular member 293, which is sensed by the pressure sensitive switch element 297 which actuates by making or breaking electrical contact in a manner well known in the art to effect the desired result of stopping the door 16, or automatically reversing the motion of the door 16.

Figure 8:
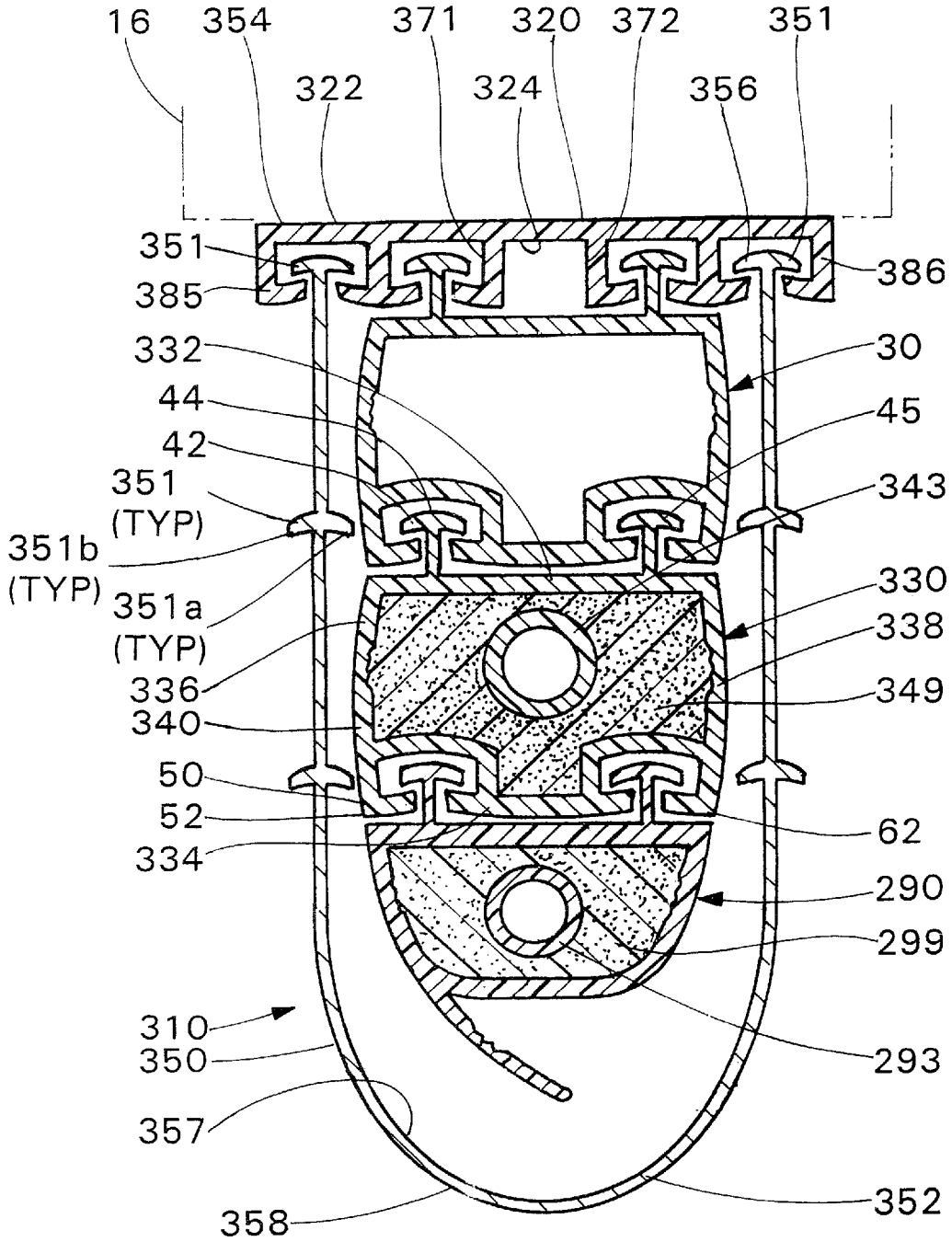
FIG. 8 is a cross-sectional view similar to FIG.

Referring now to FIG. 8, a third embodiment of an adjustable-height sensing edge 310 in accordance with the present invention is shown. The third embodiment 310 is similar to the second embodiment 210 except that a side impact sensing spacer member 330 has been added between the first spacer member 30 and the force sensor 290, a second protective outer sheath 350 has been provided which covers the spacer member 30, sensing spacer member 330 and force sensor 290, and the first base member 20 has been replaced with a third base member 320 to provide provisions for attaching the protective outer sheath 350.

As shown in FIG. 8, the side impact sensing spacer member 330 is similar to the pneumatic force sensor 290, as previously described, and accordingly, only the differences from the force sensor 290 are described in detail. In the side impact sensing spacer member 330, the sheath 340 is configured to have the same cross-section as the spacer member 30. First and second male connectors 44 and 45 are provided on the first side 332 of the side impact sensing spacer member 330, and first and second female connector channels 52 and 62 are provided on the second side 334, such that the side impact sensing spacer member 330 can be interchanged with a spacer member 30, if desired.

A tubular member 343 having sealed ends is located inside the sheath 340. The tubular member 343 extends almost the complete length of the sheath 340 and is longitudinally positioned and completely enclosed within the sheath 340. The tubular member 343 has a generally circular cross-section, but may be of other cross-sectional shapes, such as square or oval (not shown). Preferably, the tube 343 is fabricated of resiliently compressible air impervious material, such as rubber or closed cell foam. In the preferred embodiment, the tubular member 343 is similar to the tubular member 293 described above in connection with FIG. 5, and accordingly further description is not believed necessary or limiting.

Preferably, a resiliently compressible inner formation 349, similar to the resiliently compressible formation 299 described above in connection with FIG. 5, is disposed in the area between the sheath 340 and the tubular member 343. The resiliently compressible inner formation 349 extends generally along the entire length of the tubular member 343. In the presently preferred embodiment, the resiliently compressible inner formation 349 is preferably fabricated essentially of open cell foam and is substantially co-extensive with the sheath 340. However, those of ordinary skill in the art will recognize from the present disclosure that the resiliently compressible inner formation 349 is not necessary, and may be omitted depending on the sensitivity required.

Preferably, a second pressure sensor (not shown), similar to the pressure sensor 297 described above, is in communication with the interior of the tube 343 to detect a change in the internal pressure in the tubular member 343 when an object contacts the side 336 or 338 of the side impact sensing spacer member 330, in a similar manner to the pressure sensor 297 in the force sensor 290, as described above, in effect providing a spacer member which includes a second force sensor. The pressure sensor is connected to the stopping device by wires or conductors (not shown) such that the stopping device stops and/or reverses movement of the door upon detection of a side impact. Those of ordinary skill in the art will also recognize that the side impact detecting spacer member also acts as a second force sensor for objects that are in the path of the leading edge 18 of the door 16 as it closes, and, depending on the stopping distance of the door 16 after the force sensor 290 contacts an object and signals the stopping device, the side impact sensing spacer member 330 transmits a second signal.

Still with reference to FIG. 8, the second protective outer sheath 350 is similar to the first protective outer sheath 150, and like elements have been identified with similar numbers having the prefix "3". For example, the wall 152 is similar to the wall 352, and has been identified in drawings for ease of reference only. Accordingly, only the differences are described below. A plurality of ribs 351 which extend the entire length of the protective outer sheath 350 have replaced the male connector members 144. The ribs 351 have a first portion 351*a,* which protrudes inwardly from the first surface 357 of the protective outer sheath, and a second portion 351*b,* which protrudes outwardly from the second surface 358 of the second protective outer sheath 350 in an aligned position with the respective first portion 351*a*. The ribs 351 have a profile similar to the retainer portion 48 of the male connector members 44, 45 described above. However, it is understood by those of ordinary skill in the art that the profile of the ribs 351 could be circular or rectilinear, if desired. The ribs 351 provide a wear surface along the jams of the doors to provide additional wear resistance for the adjustable height sensing edge, and also can be utilized as connector attachments for the second protective outer sheath 340.

Still with reference to FIG. 8, the third base member 320 is similar to the second base member 120 described above, except the fifth through eighth female connector channels 171, 172, 185 and 186 have been replaced with ninth through twelfth female connector channels 371, 372, 385 and 386. The ninth through twelfth female connector channels are similar to the fifth through eighth female connector channels 171, 172, 185, 186 except the ninth through twelfth female connector channels 371, 372, 385, 386 are all oriented in the same direction, away from the second surface 334 of the third base member 320. The construction of third base member 320 with the ninth through twelfth female connector channels 371, 372, 385, 386 is similar to the first and second base members 20, 120, as is understood by those of ordinary skill in the art from the present disclosure, and accordingly, further description is not believed necessary or limiting.

Figure 9:
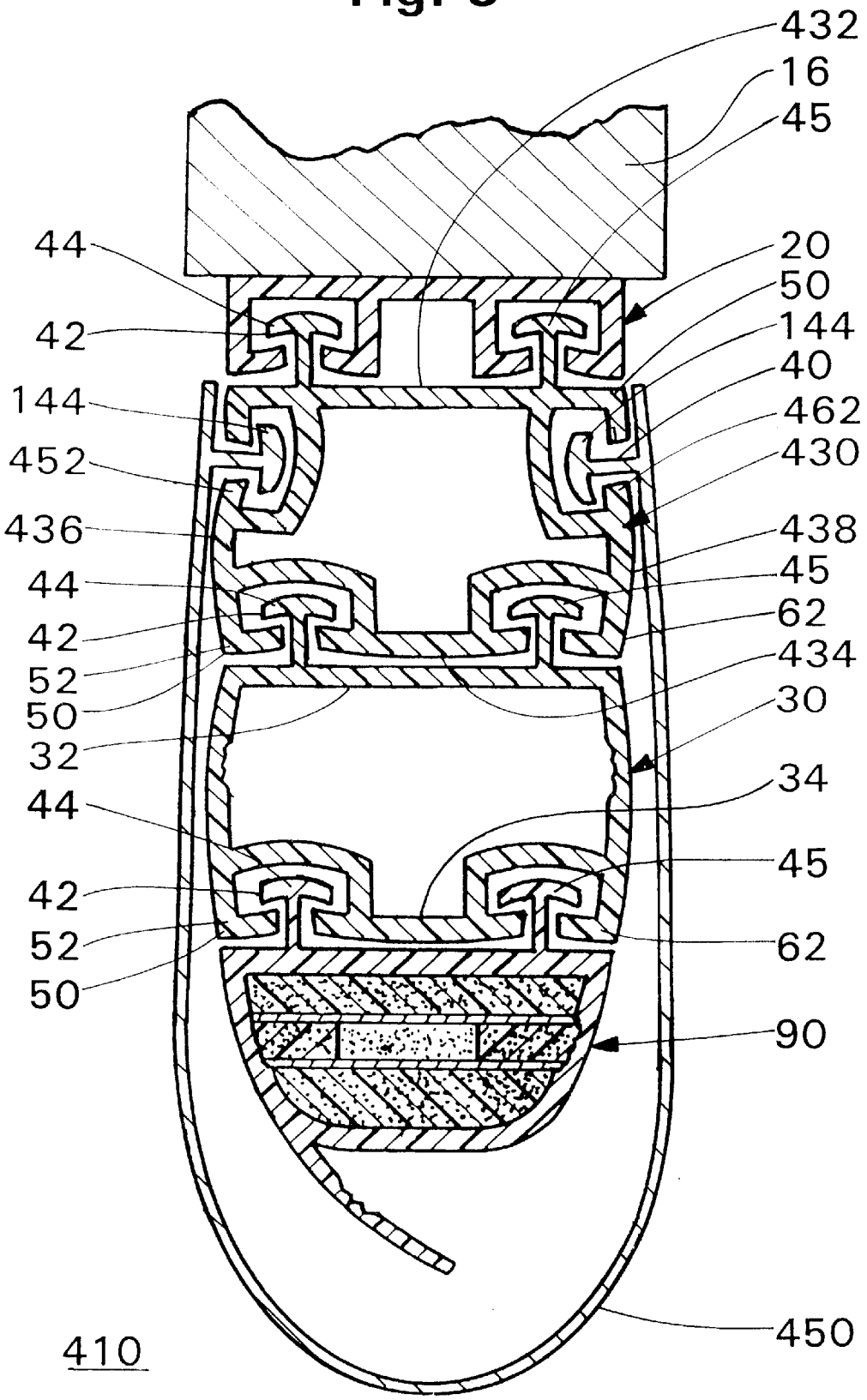
FIG. 9 is a cross-sectional view similar to FIG. 7 of a fourth preferred embodiment of an adjustable height sensing edge in accordance with the present invention.

Referring now to FIG. 9, a fourth embodiment 410 of an adjustable-height sensing edge in accordance with the present invention is shown. The fourth embodiment 410 is similar to the first embodiment 10 shown in FIG. 7, except for the differences described in detail below.

In the fourth embodiment 410, a second type of first compressible spacer member 430 is provided which is similar to and interchangeable with the spacer member 30. The second type of spacer member 430 includes two additional connector attachments of the second type 50. The two additional connector attachments of the second type 50 are preferably third and fourth female connector channels 452, 462 which are located on opposite sides of the spacer member 430. Preferably, the third and fourth female connector channels 452, 462 are formed integrally with the third and fourth sides 436, 438 which extend between the first and second sides 432, 434 of the second type of spacer member 430.

The second type of compressible spacer member 430 is preferably molded from a resilient, polymeric material having a Shore A durometer of about 60–85. In a preferred embodiment, the second compressible spacer member 430 is extruded from Santoprene™ 101-55 which is available from Monsanto Co. of St. Louis, Mo. Preferably, the second compressible spacer member 430 is a hollow, substantially rectilinear structure. However, it is understood by those of ordinary skill in the art from the present disclosure that the shape of the second type of compressible spacer member 430 can be varied, similar to the spacer member 30. Additionally, it is similarly understood that other materials and methods of manufacture can be utilized to construct the second type of spacer member 430 within the scope of the present invention.

Still with reference to FIG. 9, the second type of spacer member 430 is attached to the first base member 20 by the first and second male connector attachments 44, 45 of the first type 42 located on the first side 432 of the spacer member 430, being connected to the base member 20. A first spacer member 30 is connected to the second side 434 of the second type spacer member 430 by the first and second male connector attachments 44, 45 on the first side 32 of the first spacer member 30 engaging the first and second female connector channels 52, 62 on the second side 434 of the second spacer member 430. The force sensor 90 is attached to the second side 34 of the first spacer member 30 in the same manner as described above in connection with FIG. 4.

A third protective outer sheath 450, which is similar to the first protective outer sheath 150 as described above, is connected to the third and fourth female connector channels 452, 462 on the second type of spacer member 430. The third protective outer sheath 450 includes two male connector attachments 144 of the first type 42, located at opposite ends of the protective outer sheath 450, which are engaged with the third and fourth female connector channels 452, 462 on the second type of spacer member 430 to secure the third protective outer sheath 450 in position. Those of ordinary skill in the art will recognize from the present disclosure that the first or second outer sheaths 150, 350 could also be used in conjunction with the second spacer member 430, if desired.

Referring again to FIGS. 1–6, prior to use, the adjustable height sensing edge 10 is assembled to the leading edge 18 of the door 16 in order to protect persons, equipment and the door from impact damage caused by the closing movement of the door 16 into one of the persons and equipment by actuating the stopping device (not shown) upon detecting an object in contact with the force sensor 90 or 290 located on the leading edge 18 of the door 16 to stop the closing movement of the door. Generally, the door 16 will have a predetermined stopping distance which is a function of the door's mass, closing speed, opening and closing actuator system, and the sensitivity of the force sensor 90 or 290. The door stopping distance can be measured using a crushable rigid foam block, or may be estimated utilizing a ruler.

Referring to FIGS. 2–6, to assemble the adjustable height sensing edge 10 to the leading edge 18 of the door 16, the first base member 20 for the adjustable height sensing edge 10 is attached to the leading edge 18 of the door 16, as shown in FIGS. 2–6. Preferably, the first base member 20 is attached to the door with an adhesive or mechanical fasteners, such as screws, being installed through the first base member 20 and into the door 16.

The required number of compressible spacer members 30 to attach to the base member 20 must then determined based on the compressible height of each spacer member 30 and the predetermined stopping distance of the door 16. This is done by dividing the predetermined stopping distance by the compressible height of a spacer member 30 and rounding up to the nearest whole number. For example, if the stopping distance of a door is ¾" and the compressible height of each spacer member 30 is 0.8", a single spacer member 30 would be required, as shown in FIG. 2. If the stopping distance of the door was approximately 1.0", two compressible spacer members 30 would be required as shown in FIG. 4 as 30' and 30". Because the spacer member 30 is configured with the first type of connector attachment 42 on the first side 32 and the second type connector attachment 50 on the second side 34, the number of spacer members 30 which are installed can be selected to suit any application.

After the required number of compressible spacer members has been determined, the first compressible spacer member 30 is attached to the base member 20. Preferably, the first compressible spacer member 30 is attached to the base member 20 by attaching the connector attachment of the first type 42 on the first side 32 of the spacer member 30 to the connector attachment of the second type 50 on the second surface 24 of the base member 20. Preferably, this is accomplished by inserting the male connector members 44, 45 into the opening 60, 70 of the first and second female connector channels 52, 62. For secure attachment, it is preferred that an adhesive be used in conjunction with the connector attachments. If only a single spacer member 30 is required, as shown in FIG. 2, the force sensor 90 is attached to the spacer member 30. Preferably, the force sensor 90 is attached to the spacer member 30 by attaching the connector attachments of the first type 42 on the first side 92 of the force sensor 90 to the connector attachment of the second type 50 on the second side 34 of the spacer member 30.

If two or more spacer members 30 are required, as shown in FIG. 4, the first spacer member 30' is attached to the base member 20 in the manner described above. The second spacer member 30" is attached to the first spacer member 30' by inserting the connector attachment of the first type 42" on the first side 32" of the second spacer member 30" to the connector attachment of the second type 50' on the second side 34' of the first spacer member 30'. The first side 92 of the force sensor 90 is then attached to the second side of the last spacer member of the determined number of spacer members, which in the present case is the second spacer member 30" in the manner previously described above, or the force sensor 290 can be utilized.

Those of ordinary skill in the art will understand from the present disclosure that the type of force sensor 90, 290 can be varied, as long as provisions are provided on the force sensor 90, 290 for attachment to the second side 34 of the spacer member 30.

Referring now to FIGS. 7 through 9, if extra protection for the force sensor 90, 290 and the spacer member(s) 30 is desired, a protective outer sheath 150, 350 or 450 can be installed. In order to install a protective outer sheath 150, 350, 450, the second type of spacer member 430 can be used in conjunction with the first base member 20, as shown in FIG. 9, or the first base member 20 may be replaced with the second or third base members 120 or 320, if desired, as shown in FIGS. 7 and 8. The second or third base members 120, 320 are installed on the leading edge 18 of the door 16 in the same manner as the first base member, described above.

Referring now to FIGS. 7 and 8, after the required number of spacer members 30 have been attached to the base member 120 or 320, and the force sensor 90, 290 has been attached to the last spacer member 30, the protective outer sheath 150, 350 is installed.

In the fourth embodiment shown in FIG. 9, the second type of spacer member 430 is used in place of a spacer member 30 and is attached to the base member 20 along with any additional spacer members 30.

Referring to FIG. 7, if the first protective outer sheath 150 is utilized in connection with the second base member 120, the first protective outer sheath 150 is trimmed to a desired height based on the number of spacer members 30 such that a male connector member 144 is adjacent to each end 154, 156, and the protective outer sheath 150 is not too loose after installation. The male connector member 144 on the first end 154 of the first protective outer sheath 150 is inserted into the opening 189 of the seventh female connector channel 185 such that the retainer portion 48 is held within the cavity 188. The male connector member 144 on the second end 156 is then inserted into the opening 189 of the eighth female connector channel 186.

Referring to FIG. 8, if the second protective outer sheath 350 is utilized in connection with the second base member 320, the second protective outer sheath 350 is trimmed to a desired height based on the number of spacer members 30 such that a rib 351 is adjacent to each end 354, 356, and the protective outer sheath 350 is not too loose after installation. The rib 351 adjacent to the first end 354 of the first protective outer sheath 350 is inserted into the opening of the eleventh female connector channel 385 such that the rib 351 is held within the cavity formed by the eleventh female connector channel 385. The rib 351 on the second end 356 is then inserted into the opening of the twelfth female connector channel 386.

Still with reference to FIG. 8, if side impact sensing is desired, a side impact sensing spacer member 330 is substituted for one of the spacer members 30. Installation is the same as outlined above for the spacer members 30.

Referring now to FIG. 9, the third protective outer sheath 450 is provided in standard sizes to accommodate different numbers of spacer members 30, 430. The proper length protective outer sheath 430 is selected based on the number of spacer members 30 such that when the male connector members 144 are adjacent to the third and fourth female connector channels 452, 462 on the second type of compressible spacer member 430, the protective outer sheath 450 is not too loose after installation. The male connector members 144 on the ends of the third protective outer sheath 450 are then inserted into the third and fourth female connector channels 452, 462 on the second type of spacer member 430.

Referring to FIGS. 1–7, in use, when the door 16 is closing, if the force sensor 90, 290 detects an object in the path of the leading edge 18 of the door 16, the force sensor 90, 290 signals the stopping device (not shown) through the conductors 118, 120 or 301, 303 to stop and/or reverse the movement of the door 16 in a manner which is well known to those of ordinary skill in the art. As the door 16 continues its closing movement based on the predetermined stopping distance between the time the force sensor 90 or 290 contacts the object and the time the door 16 actually stops and/or reverses movement, the compressible spacer member (s) 30 are compressed to prevent impact damage from the closing movement of the door to protect persons, equipment and the door from impact damage over the stopping distance of the door.

Referring to FIG. 8, when a side impact sensing spacer member 330 is utilized in accordance with the third embodiment 310 of the invention, such as in warehouse applications which have doors which close at speeds of 4–5 feet per second in order to conserve heat or cooling, or to prevent excessive amounts of particulate matter from entering or escaping from an enclosed area, if an object strikes the side of the height adjustable sensing edge 310, the side impact sensing spacer member 330 detects the side impact and signals the stopping mechanism to stop and/or reverse movement of the door 16.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A protective outer sheath for a sensing edge which is attached to a door edge to protect persons, equipment and the door from impact damage from closing movement of the door by actuating a device upon detecting an object in contact with the sensing edge to halt the closing movement of the door, the protective outer sheath providing protection for the sensing edge from abrasion damage, the protective outer sheath comprising:

a flexible, elongate wall having a first end and a second end, the first and second ends being attached to the door such that the sensing edge is covered by the wall, the flexible, elongate wall having an inner surface, which is positioned adjacent to the sensing edge, and an outer surface, and a plurality of ribs disposed longitudinally along the outer surface.

2. The protective outer sheath of claim 1 wherein the protective outer sheath further includes at least one connector member.

3. The protective outer sheath of claim 1 wherein the ribs are configured as connectors for attaching the sheath to the door.

4. An adjustable height sensing edge for a door to protect persons, equipment and the door from impact damage from closing movement of the door by actuating a stopping device upon detecting an object in contact with the sensing edge, the stopping device stopping the closing movement of the door, the adjustable height sensing edge comprising:

a first sensorless compressible spacer member having opposing first and second sides, the first side of the sensorless spacer member being adapted for attachment to the door;

a second sensorless compressible spacer member connected to the first sensorless compressible spacer member, the second spacer member having opposing first and second sides, the first side of the second spacer member being connected to the second side of the first spacer member, the first and second spacer elements being interchangeable; and a force sensor for sensing the object in contact with the sensing edge and activating the stopping device, the force sensor having opposing first and second sides, the first side of the force sensor being connected to the second side of the second sensorless compressible spacer member.

5. The adjustable height sensing edge of claim 4 further comprising a base member attached to the first side of the spacer member and having opposing first and second surfaces, the first surface of the base member being adapted for attachment to the door.

6. The adjustable height sensing edge of claim 5 wherein the first side of the spacer member includes a connector attachment of a first type, and the second side of the spacer member includes a connector attachment of a second type, and wherein the base member further includes a connector attachment of the second type on the second surface of the base member, the spacer member being connected to the base member by engagement of the connector attachment of the first type on first side of the spacer member engaging the connector attachment of the second type on the second surface of the base member; and wherein the first side of the force sensor includes a connector attachment of the first type, the force sensor being attached to the spacer member by the connector attachment of the first type on the first side of the force sensor engaging the connector attachment of the second type on the second side of the spacer member.

7. The adjustable height sensing edge of claim 6 wherein the connector attachment of the first type comprises a male connector member and the connector attachment of the second type comprises a female connector channel.

8. The adjustable height sensing edge of claim 6 wherein the connector attachment of the first type comprises two male connector members and the connector attachment of the second type comprises two female connector channels.

9. The adjustable height sensing edge of claim 4 wherein the spacer member is made from a resilient material.

10. The adjustable height sensing edge of claim 4 wherein the force sensor is an electrical switch.

11. The adjustable height sensing edge of claim 4 wherein the force sensor is a pneumatic switch.

12. An adjustable height sensing edge for a door to protect persons, equipment and the door from impact damage from closing movement of the door by actuating a stopping device upon detecting an object in contact with the sensing edge, the stopping device stopping the closing movement of the door, the adjustable height sensing edge comprising:

at least a first sensorless compressible spacer member having opposing first and second sides;

a base member attached to the first side of the spacer member and having opposing first and second surfaces, the first surface of the base member being adapted for attachment to the door for attaching the first side of the sensorless spacer member to the door;

a force sensor for sensing the object in contact with the sensing edge and activating the stopping device, the force sensor having opposing first and second sides, the first side of the force sensor being connected to the second side of the first sensorless compressible spacer member; and a protective outer sheath which covers the first sensorless compressible spacer member and the force sensor, the protective outer sheath including a flexible, elongate wall having a first end and a second end, the first and second ends being attached to one of the door, the base member and the first sensorless compressible spacer member, the protective outer sheath has an inner surface and an outer surface, and wherein the protective outer sheath further comprises a plurality of ribs disposed longitudinally on one of the inner and outer surfaces.

13. The adjustable height sensing edge of claim 12 wherein the protective outer sheath further includes at least one connector member.

14. The adjustable height sensing edge of claim 12 wherein the ribs are configured as connectors for attaching the sheath to one of the door, the base member and the first sensorless compressible spacer member.

15. The adjustable height sensing edge of claim 12 wherein the first sensorless compressible spacer member includes third and fourth sides connected between opposite ends of the first and second sides, and the first and second ends of the protective outer sheath are connected to the third and fourth sides of the first sensorless compressible spacer member.

* * * * *